US011155452B2

(12) United States Patent
Rushton et al.

(10) Patent No.: US 11,155,452 B2
(45) Date of Patent: Oct. 26, 2021

(54) WORKING MACHINE AND A CONTROLLER

(71) Applicant: J.C. BAMFORD EXCAVATORS LIMITED, Uttoxeter (GB)

(72) Inventors: Tom Rushton, Uttoxeter (GB); Richard Brooks, Uttoxeter (GB)

(73) Assignee: J.C. BAMFORD EXCAVATORS LIMITED, Uttoxeter (GB)

( * ) Notice: Subject to any disclaimer, the term of this patent is extended or adjusted under 35 U.S.C. 154(b) by 0 days.

(21) Appl. No.: 16/806,985

(22) Filed: Mar. 2, 2020

(65) Prior Publication Data

US 2020/0277175 A1 Sep. 3, 2020

(30) Foreign Application Priority Data

| | | |
|---|---|---|
| Mar. 1, 2019 | (GB) | 1902826 |
| Mar. 1, 2019 | (GB) | 1902827 |
| Mar. 12, 2019 | (GB) | 1903399 |
| Mar. 29, 2019 | (GB) | 1904474 |

(51) Int. Cl.

| | |
|---|---|
| ***B66F 9/20*** | (2006.01) |
| ***E02F 3/43*** | (2006.01) |
| ***B66F 9/065*** | (2006.01) |
| ***B66F 9/22*** | (2006.01) |
| ***B66F 9/24*** | (2006.01) |

(52) U.S. Cl.

CPC ..... *B66F 9/20* (2013.01); *B66F 9/0655* (2013.01); *B66F 9/22* (2013.01); *B66F 9/24* (2013.01)

(58) Field of Classification Search

CPC ..... E02F 3/433; E02F 3/436; E02F 3/3414; B66F 9/20; B66F 9/22; B66F 9/0655

See application file for complete search history.

(56) References Cited

U.S. PATENT DOCUMENTS

| | | | | |
|---|---|---|---|---|
| 4,573,319 A * | 3/1986 | Chichester | ..... | B62D 5/07 60/422 |
| 5,921,338 A | 7/1999 | Edmondson | | |
| 6,134,816 A | 10/2000 | Murakami et al. | | |
| 6,688,481 B1 | 2/2004 | Adner et al. | | |
| 9,073,739 B2 * | 7/2015 | Woods | ..... | E02F 3/286 |

(Continued)

FOREIGN PATENT DOCUMENTS

| | | |
|---|---|---|
| AT | 405780 B | 11/1999 |
| CN | 2297437 Y | 11/1998 |

(Continued)

OTHER PUBLICATIONS

U.S. Appl. No. 16/806,912, filed Mar. 2, 2020.

(Continued)

*Primary Examiner* — Gerald McClain

(74) *Attorney, Agent, or Firm* — Marshall, Gerstein & Borun LLP

(57) ABSTRACT

A working machine has a body and a load handling apparatus coupled to the body. The load handling apparatus is moveable with respect to the body by an electrically driven actuator assembly. A controller is configured to receive a tilt signal representative of a moment of tilt of the working machine and issue a control signal configured to control an electrical drive element of the electrically driven actuator assembly based on the value of the tilt signal relative to a tilt threshold.

19 Claims, 3 Drawing Sheets

(56) References Cited

U.S. PATENT DOCUMENTS

| | | | | |
|---|---|---|---|---|
| 9,248,731 | B2 | 2/2016 | Soma' et al. | |
| 9,540,788 | B2 | 1/2017 | Naito | |
| 9,550,659 | B2 | 1/2017 | Nakazawa et al. | |
| 2002/0148144 | A1 | 10/2002 | Tokunaga | |
| 2003/0095857 | A1* | 5/2003 | Degelman | E02F 3/3604 414/685 |
| 2005/0216105 | A1* | 9/2005 | Tabor | E02F 3/433 700/63 |
| 2009/0283346 | A1* | 11/2009 | Katae | B66F 9/07572 180/68.2 |
| 2012/0039696 | A1 | 2/2012 | Brooks et al. | |
| 2012/0279938 | A1 | 11/2012 | Benton et al. | |
| 2013/0049404 | A1 | 2/2013 | Uesugi | |
| 2013/0071212 | A1* | 3/2013 | Yunoue | E02F 9/0808 414/685 |
| 2014/0000975 | A1 | 1/2014 | Ueda | |
| 2014/0196558 | A1* | 7/2014 | Meislahn | E02F 9/2087 74/471 XY |
| 2014/0234062 | A1 | 8/2014 | Adachi et al. | |
| 2014/0265254 | A1* | 9/2014 | Sekine | B66F 9/065 280/638 |
| 2014/0271078 | A1* | 9/2014 | Koch | E02F 9/2004 414/723 |
| 2015/0053489 | A1 | 2/2015 | Nakazawa et al. | |
| 2015/0090517 | A1 | 4/2015 | Okuda et al. | |
| 2015/0375977 | A1 | 12/2015 | Nakazawa et al. | |
| 2016/0134001 | A1 | 5/2016 | Lindholm et al. | |
| 2018/0319392 | A1* | 11/2018 | Posselius | E02F 9/24 |
| 2018/0334201 | A1* | 11/2018 | Meager | G05D 1/0891 |
| 2020/0263390 | A1* | 8/2020 | Raj | E02F 3/3622 |
| 2021/0016648 | A1* | 1/2021 | Iotti | B66F 9/07559 |
| 2021/0032847 | A1* | 2/2021 | Carlson | B60K 5/12 |

FOREIGN PATENT DOCUMENTS

| | | | |
|---|---|---|---|
| CN | 201049874 | Y | 4/2008 |
| CN | 201501336 | U | 6/2010 |
| CN | 102730601 | A | 10/2012 |
| CN | 203112423 | U | 8/2013 |
| CN | 103443016 | A | 12/2013 |
| CN | 104960567 | A | 10/2015 |
| CN | 207632459 | U | 7/2018 |
| DE | 102005042940 | A1 | 3/2007 |
| DE | 202014000738 | U1 | 3/2014 |
| DE | 102013113809 | A1 | 6/2015 |
| DE | 202016101145 | U1 | 3/2016 |
| EP | 2965939 | A1 | 1/2016 |
| GB | 1361832 | A | 7/1974 |
| GB | 2529286 | A | 2/2016 |
| JP | 2004168149 | A | 6/2004 |
| JP | 2005067522 | A | 3/2005 |
| JP | 2012201187 | A | 10/2012 |
| JP | 2012201188 | A | 10/2012 |
| KR | 20110071980 | A | 6/2011 |
| KR | 20120121577 | A | 11/2012 |
| KR | 20170046366 | A | 5/2017 |
| WO | WO-2010/058768 | A1 | 5/2010 |

OTHER PUBLICATIONS

U.S. Appl. No. 16/806,950, filed Mar. 2, 2020.
Search Report for GB1902826.5, dated Aug. 23, 2019.
Search Report for GB1902827.3, dated Aug. 1, 2019.
Search Report for GB 1904474.2, dated Sep. 24, 2019.
Extended European Search Report for EP 20 16 0238, dated Jul. 22, 2020.
Extended European Search Report for EP 20 16 0255, dated Jul. 23, 2020.
Extended European Search Report for EP 20 16 0256, dated Jul. 28, 2020.
Search Report for GB 1904474.2, dated Sep. 25, 2019.

* cited by examiner

WORKING MACHINE AND A CONTROLLER

TECHNICAL FIELD

The present invention relates to a controller for a working machine including a load handling apparatus, and a working machine including such a controller.

BACKGROUND

Working machines including a load handling apparatus typically include a front and a rear axle supporting a body on which the load handling apparatus is mounted. Wheels are normally coupled to the front and rear axles, the wheels being configured to engage the ground and permit movement of the working machine across the ground.

The load handling apparatus includes, for example, an extendable lifting arm moveable by one or more actuators with respect to the working machine body. The lifting arm includes a load carrying implement to carry a load such that a load carried by the load carrying implement can be moved with respect to the body by the lifting arm.

Movement of the load produces a moment of tilt about an axis of rotation of one of the front or rear axles. Alternatively, a moment of tilt may be induced about another axis where, for example, stabilizers are used to stabilise the body relative to the ground during load handling operations.

Extension of the lifting arm in a forwards direction, particularly when carrying a load, induces a moment of tilt about the axis of rotation of the front axle. As a result the portion of the working machine (and load) weight supported by the rear axle decreases.

In order to ensure that the working machine does not rotate about the front axle to such an extent that the wheels coupled to the rear axle are lifted from the ground surface (i.e. to ensure that the working machine does not tip), a controller prevents or restricts further movement of the lifting arm when the load on the rear axle reduces to a threshold level. An example of a working machine including such a controller to prevent tipping can be found in EP 1,532,065.

The lifting arm is typically moved using a hydraulic actuator under the control of a machine operator. Hydraulic fluid is provided by a hydraulic pump which is driven by the engine of the working machine. The controller restricts the movement of the lifting arm by controlling a valve which restricts the supply of hydraulic fluid to the hydraulic actuator as the tipping threshold approaches, overriding any control input from the machine operator. Once the tipping threshold is reached, the controller prevents further movement of the lifting arm by diverting hydraulic fluid away from the hydraulic actuator into a tank. The working machine engine runs constantly while the working machine is in operation meaning that the hydraulic pump is always running as well, even if the flow of hydraulic fluid is being restricted or the hydraulic fluid is being diverted into the tank—this is not particularly efficient.

The present inventions seeks to provide a means to prevent tipping with improved efficiency.

SUMMARY OF THE INVENTION

An aspect of the present invention provides a controller for use with a working machine, the working machine comprising:

a body and a load handling apparatus coupled to the body, wherein the load handling apparatus is moveable with respect to the body by an electrically driven actuator assembly;

wherein the controller is configured to:

receive a tilt signal representative of a moment of tilt of the working machine, and issue a control signal configured to control an electrical drive element of the electrically driven actuator assembly based on the value of the tilt signal relative to a tilt threshold.

Directly controlling an electrical drive element (such as an electric motor driven hydraulic pump or an electric actuator) provides a more efficient way to control the speed and movement of the load handling apparatus to avoid tipping rather than by restricting or diverting hydraulic fluid from a hydraulic pump that is always running off the engine. For example, rather than having a hydraulic pump still running when movement of the electrically driven actuator assembly has been stopped because a value of the tilt signal has reached a tilt threshold, there is no need to drive the electrical drive assembly, saving energy. It is particularly advantageous for electric working machines which do not have an engine running constantly to power a hydraulic pump and where energy savings help to preserve battery life.

The control signal may be configured to reduce the speed of the electrical drive element as the value of the tilt signal approaches the tilt threshold.

The control signal may be configured to prevent (stop) movement of the electrically driven actuator assembly when the value of the tilt signal reaches or exceeds the tilt threshold. The control signal may be configured to prevent movement of the electrically driven actuator assembly which would cause the value of the tilt signal to reach or exceed the tilt threshold (i.e. preventing any movement that would increase the risk of the working machine tipping).

The control signal may be configured so that when the value of the tilt signal reaches or exceeds the tilt threshold, the control signal allows movement of the electrically driven actuator assembly in one or more directions which would cause the value of the tilt signal to reduce below the tilt threshold (i.e., so that the load handling apparatus can be freely moved in one or more directions that reduces the risk of the working machine tipping). When moving the hydraulic actuator in one or more directions that reduces the value of the tilt signal below the tilt threshold (i.e., in one or more directions that reduces the risk of the working machine tipping), the speed of the hydraulic pump may be increased to increase the supply of hydraulic fluid to the hydraulic actuator. In this way, restrictions imposed on the hydraulic actuator as the tilt threshold was approached may be progressively lifted as the hydraulic actuator backs away from the tilt threshold.

The electrically driven actuator assembly optionally comprises an electric linear actuator and the electrical drive element comprises the electric linear actuator.

The electrical drive element may comprise an electric motor, such as a motor that generates rotational motion (to drive a mechanical assembly in the linear actuator which converts the rotational motion into linear motion) or a linear motor.

The electrically driven actuator assembly optionally comprises a hydraulic actuator and an electrically driven hydraulic pump configured to provide hydraulic fluid to the hydraulic actuator, wherein the electrical drive element comprises the electrically driven hydraulic pump and wherein the control signal is configured to control the electrically driven hydraulic pump to control a supply of hydraulic fluid to the hydraulic actuator based on the value of the tilt signal relative to the tilt threshold.

The control signal may be configured to control the electrically driven hydraulic pump to restrict (for example, reduce) the supply of hydraulic fluid to the hydraulic actuator in order to restrict movement of the load handling apparatus based on the value of the tilt signal relative to the tilt threshold.

The control signal may be configured to control the electrically driven hydraulic pump to restrict the supply of hydraulic fluid to the hydraulic actuator in order to restrict movement of the load handling apparatus by indicating a reduction in the speed of the hydraulic pump.

The control signal is optionally configured to stop the electrically driven hydraulic pump based on the value of the tilt signal reaching or exceeding the tilt threshold to substantially prevent the supply of hydraulic fluid to the hydraulic actuator in order to prevent a movement of the load handling apparatus which would increase the value of the tilt signal above the tilt threshold (i.e., preventing any movement that would increase the risk of the working machine tipping).

The control signal is optionally configured so that, when the value of the tilt signal reaches or exceeds the tilt threshold, the control signal causes the electronically driven hydraulic pump to supply hydraulic fluid to the hydraulic actuator only so that the hydraulic actuator can be moved in one or more directions which reduces the value of the tilt signal below the tilt threshold (i.e., so that the load handling apparatus can be freely moved in one or more directions that reduces the risk of the working machine tipping). When moving the hydraulic actuator in one or more directions that reduces the value of the tilt signal relative to the tilt threshold (i.e., one or more directions that reduce the risk of the working machine tipping), the speed of the hydraulic pump may be increased to increase the supply of hydraulic fluid to the hydraulic actuator.

The controller is further optionally configured to receive a load orientation signal representative of an orientation of the load handling apparatus with respect to a reference orientation, the tilt threshold being dependent on the load orientation signal.

The load orientation signal may represent an angle of the load handling apparatus with respect to the reference orientation.

The reference orientation may be one of: gravity; a horizontal level; and an orientation of the load handling apparatus relative to an orientation of the working machine.

The controller may further be configured to receive a stabilizer signal representative of whether one or more stabilizers of the working machine are deployed, and the tilt threshold is further dependent on the stabilizer signal.

The tilt signal optionally represents the load on an axle of the working machine.

A second aspect of the present invention provides a control system incorporating a controller according to the first aspect of the present invention.

A third aspect of the present invention provides a working machine incorporating a controller according to the first aspect of the present invention or a control system according to the second aspect of the present invention.

The working machine may further comprise a body and a load handling apparatus.

The load handling apparatus may comprise a lifting arm, the lifting arm being at least pivotable with respect to the working machine body.

The lifting arm may be pivotable about a substantially transverse axis of the working machine and the lifting arm extends substantially parallel to a longitudinal axis of the working machine.

The lifting arm may be pivotable about a location between a longitudinal mid-point of the body and a rear of the body.

The lifting arm is optionally telescopic.

The lifting arm may have a fixed orientation in a vertical plane with respect to the body.

A load handling implement may be mountable to the lifting arm forward of the body.

The working machine optionally further comprises a ground engaging propulsion structure to permit movement thereof over the ground.

The ground engaging propulsion structure may be electrically propelled.

The working machine may further comprise an electrical energy store configured to provide electrical energy to the actuator assembly, and optionally to propel the working machine.

The electrical energy store may comprise a battery, and/or a capacitor and/or a fuel cell.

The working machine may further comprise one or more stabilizer legs.

The actuator assembly optionally comprises a hydraulic actuator and an electrically driven hydraulic pump.

The electrically driven hydraulic pump may comprise an electric motor and the working machine comprises an independent electric steering motor and/or an independent electric traction motor.

The actuator assembly optionally comprises an electric actuator.

BRIEF DESCRIPTION OF THE DRAWINGS

The invention shall now be described, by way of example only, with reference to the accompanying drawings, in which.

DETAILED DESCRIPTION

Figure 1:
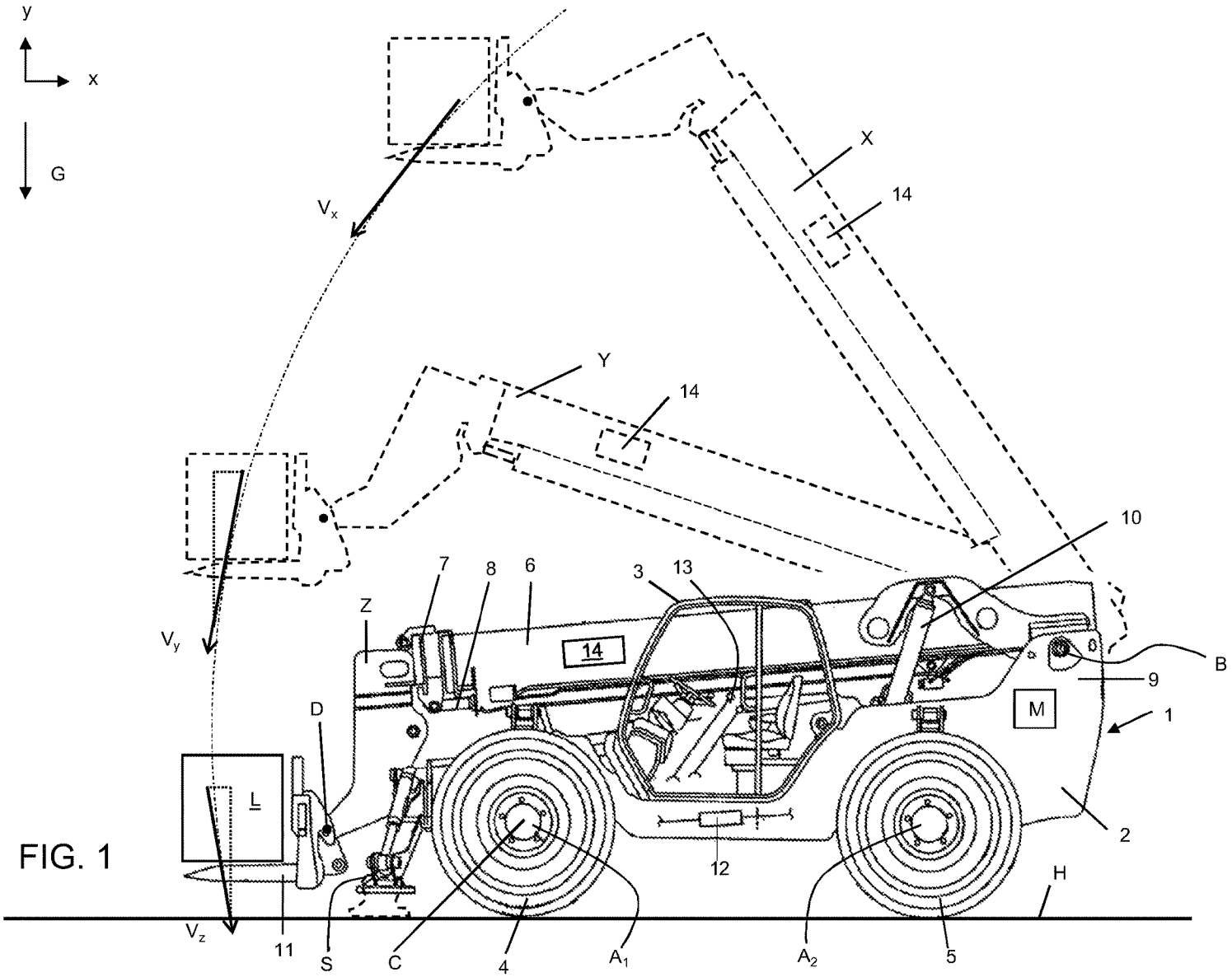
FIG. 1 illustrates a working machine according to an embodiment of the invention.

FIG. 1 shows an example of a working machine 1 which may be a load handling working machine. In this example, the load handling working machine is a telescopic handler. In other cases, the load handling working machine may be a skid-steer loader, a compact track loader, a wheel loader, or a telescopic wheel loader, for example. Such working machines may be denoted as off-highway working machines. The working machine 1 includes a body 2 which may include, for example, an operator's cab 3 from which an operator can operate the working machine 1 using controls 13, such as levers and/or a joystick.

The working machine 1 has a ground engaging propulsion structure comprising a first axle $A_1$ and a second axle $A_2$, each axle being coupled to a pair of wheels (two wheels 4, 5 are shown in FIG. 1 with one wheel 4 connected to the first axle $A_1$ and one wheel 5 connected to the second axle $A_2$). The first axle $A_1$ may be a front axle and the second axle $A_2$ may be a rear axle. One or both of the axles $A_1$, $A_2$ may be coupled to an electric motor M powered by a battery or fuel cell, to drive movement of one or both pairs of wheels 4, 5.

The wheels may contact a ground surface H and rotation of the wheels 4, 5 may cause movement of the working machine with respect to the ground surface. Alternatively, the ground engaging propulsion structure may comprise tracks.

At least one of the first and second axles $A_1$, $A_2$ may be coupled to the working machine body 2 by a pivot joint (not shown) located at substantially the centre of the axle such that the axle can rock about a longitudinal axis of the working machine 1—thus, improving stability of the working machine 1 when moving across uneven ground. It will be appreciated that this effect can be achieved in other known manners.

A load handling apparatus 6, 7 is coupled to the working machine body 2. The load handling apparatus 6, 7 may be mounted by a mount 9 to the working machine body 2. The load handling apparatus 6, 7 includes a lifting arm 6, 7. The lifting arm 6, 7 may be a telescopic arm having a first section 6 connected to the mount 9 and a second section 7 which is telescopically fitted to the first section 6. The second section 7 of the lifting arm 6, 7 is telescopically moveable with respect to the first section 6 such that the lifting arm 6, 7 can be extended and retracted.

Movement of the first section 6 with respect to the second section 7 of the lifting arm 6, 7 may be achieved by use of an extension actuator 8 which may be a double acting hydraulic linear actuator or an electric linear actuator. One end of the extension actuator 8 is coupled to the first section 6 of the lifting arm 6, 7 and another end of the extension actuator 8 is coupled to the second section 7 of the lifting arm 6, 7 such that extension of the extension actuator 8 causes extension of the lifting arm 6, 7 and retraction of the extension actuator 8 causes retraction of the lifting arm 6, 7. As will be appreciated, the lifting arm 6, 7 may include a plurality of sections: for example, the lifting arm 6, 7 may comprise two, three, four or more sections. Each arm section may be telescopically fitted to at least one other section.

The lifting arm 6, 7 can be moved with respect to the working machine body 2 and the movement is preferably, at least in part, rotational movement about the mount 9 (about pivot B of the lifting arm 6, 7). The rotational movement is about a substantially transverse axis of the working machine 1, the pivot B being transversely arranged. Rotational movement of the lifting arm 6, 7 with respect to the working machine body 2 is achieved by use of at least one lifting actuator 10 coupled, at one end, to the first section 6 of the lifting arm 6, 7 and, at a second end, to the working machine body 2. The lifting actuator 10 is a double acting hydraulic linear actuator, but may alternatively be single acting, or an electric linear actuator.

FIG. 1 shows the lifting arm 6, 7 positioned at three positions, namely X, Y and Z, with positions X and Y shown in dashed lines in simplified form. When positioned at position X the angle between the lifting arm 6, 7 and a ground level is 55 degrees. This angle is measured with respect to the longitudinal major portion of the lifting arm 6, 7, i.e. the part that extends and retracts if the arm is telescopic. In other embodiments, a different measure of the angle may be used, for example, an angle defined using a notional line between the pivot B and the pivot D for the load handling implement (see below). When positioned at position Y the angle is 27 degrees. When positioned at position Z the angle is −5 degrees. 55 degrees and −5 degrees represent the upper and lower limits of angular movement for the working machine 1 with stabilizers S retracted. The upper limit may be permitted to be increased to, say, 70 degrees when the stabilizers S are deployed to contact the ground (see below). Clearly, the lifting arm 6, 7 can be positioned at any angle between these limits. Other working machines may have different upper and lower angular limits dependent upon the operational requirements of the working machine (maximum and minimum lift height and forward reach etc.) and the geometry of the working machine and load handling apparatus (e.g. position of pivot B, dimensions of cranked portion at the distal end of the second section 7 of the lifting arm 6, 7). As will be appreciated, when the lifting arm 6, 7 is positioned relatively close to the ground it is at a relatively small angle and when it is positioned relatively remotely from the ground it is at a relatively large or high angle.

A load handling implement 11 may be located at a distal end of the lifting arm 6, 7. The load handling implement 11 may include a fork-type implement which may be rotatable with respect to the lifting arm 6, 7 about a pivot D, this pivot also being transversely arranged. Other implements may be fitted such as shovels, grabs etc. Movement of the load handling implement 11 may be achieved by use of a double acting linear hydraulic actuator (not shown) coupled to the load handling implement 11 and the distal end of the section 7 of the lifting arm 6, 7 or an electric linear actuator.

Off-highway working machines 1 such as those according to the present invention are configured to transport loads L over uneven ground, i.e. with a load held by the load handling implement 11, an operator controls the propulsion structure to move the entire working machine with the load from one location to another. This may be contrasted with working machines such as mobile cranes and roto-telehandlers in which a boom is pivotable about both a lateral and an upright axis—i.e. the boom can slew relative to a working machine body on a turret or turntable—as well as pivot upwards about the lateral axis. Such working machines may be driven to a particular location and are immobilised on four or more stabilizer legs to lift the wheels or other propulsion means entirely off the ground, and to ensure the upright slew axis is absolutely vertically aligned. From that fixed location the working machine will move a load from one location to another location using movements of the boom about the lateral and upright axes. As such, different stability considerations apply to working machines in which a boom can also move about an upright axis. Therefore different safety legislation, and consequently different safety systems, are employed on such working machines.

When the working machine 1 lifts a load L supported by the load handling implement 11, the load L (and implement 11) will produce a moment about an axis of the working machine 1 which causes the working machine to tend to tilt about that axis. The moment is, therefore, referred to herein as a moment of tilt. In the depicted example, this axis of the working machine 1 about which the working machine 1 is likely to tilt is axis C—i.e. about the first (or front) axle $A_1$. If the lifting arm 6, 7 is stopped suddenly when the lifting arm 6, 7 is carrying a heavy load L and/or moving a load L at high speed, the inertia may be sufficient to cause the working machine to tip.

Figure 2:
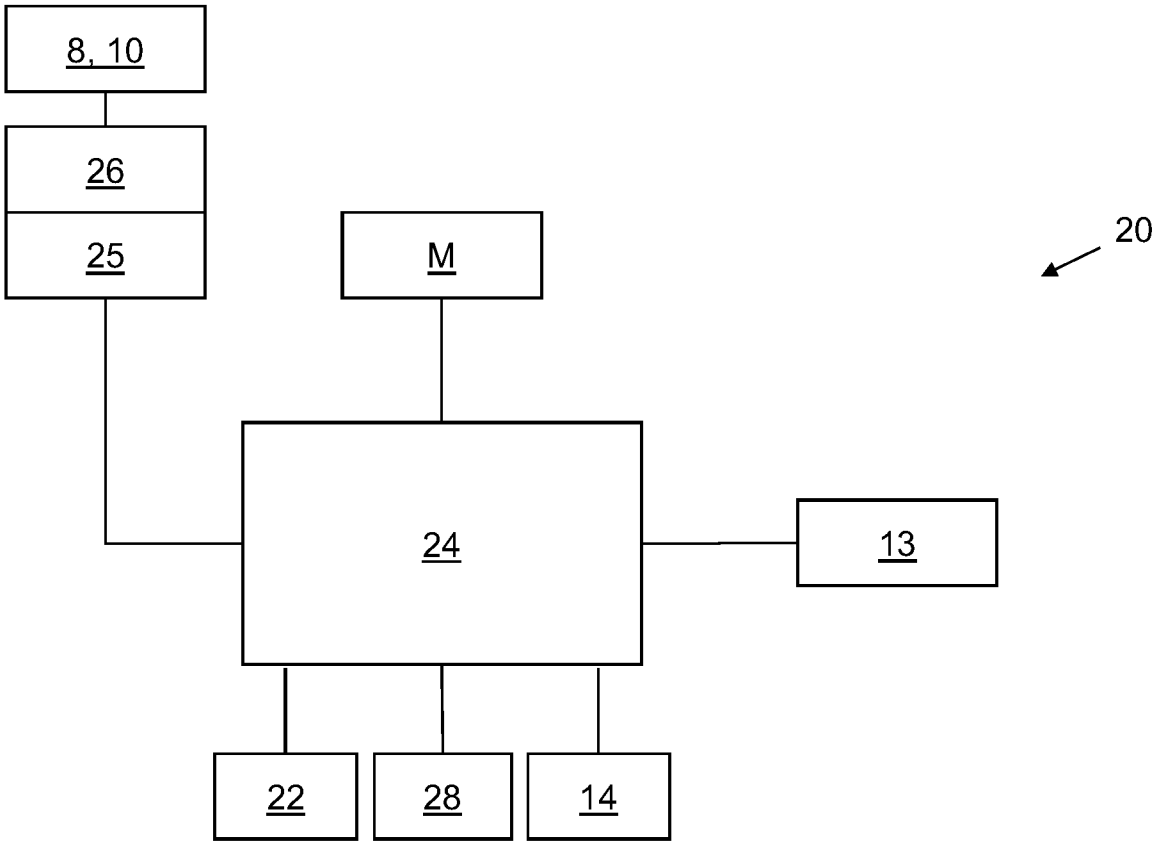
FIG. 2 illustrates a control system of the working machine of FIG. 1 according to an embodiment of the invention.

FIG. 2 shows a system 20 for sensing tilt and adjusting the behaviour of the lifting arm 6, 7 to prevent the working machine 1 from tipping over.

The system 20 includes a tilt sensor 22 configured to sense a parameter which is representative of a moment of tilt of the working machine 1 about an axis. The tilt sensor 22 is further configured to issue a signal to a controller 24 such that a moment of tilt of the working machine about an axis can be determined.

The tilt sensor 22 may include a strain gauge coupled to an axle $A_1$, $A_2$ of the working machine 1. The tilt sensor 22 may include a load cell located between the working machine body 2 and an axle and configured to sense the load (or weight) on the axle. The tilt sensor 22 may be coupled to or otherwise associated with the second (or rear) axle $A_2$. The tilt sensor 22 may include several sensors which sense different parameters and use these parameters to generate a signal such that a moment of tilt of the working machine 1 can be determined. The tilt sensor 22 may take other forms, as will be appreciated, such as by monitoring fluid pressure in one or more actuators, or utilising strain gauges located on the load handling apparatus.

The controller 24 receives a tilt signal from the tilt sensor 22 representative of a moment of tilt of the working machine 1. The controller 24 may be any suitable microprocessor type controller and the signals may be transmitted by any suitable wired or wireless communication system or protocol, such as via a CAN bus of the working machine 1.

In this embodiment, an orientation sensor arrangement 14 (see FIGS. 1 and 2) may also be provided and is configured to sense a parameter representative of a position of at least a portion of the load handling apparatus 6, 7 with respect to a reference orientation. For example, this reference orientation may be horizontal ground H (a horizontal reference datum) or the direction of the force due to gravity G (a vertical reference datum and hereinafter referred to as "gravity"). In other embodiments the orientation may be a relative orientation e.g. of the load handling apparatus 6, 7 relative to the machine body. A suitable orientation sensor arrangement may incorporate a gyroscope or accelerometer, or a gyroscope/accelerometer on both the load handling apparatus 6, 7 and the machine body to determine a relative orientation, or an angle sensor (potentiometer).

The orientation sensor arrangement 14 is further configured to issue a signal to the controller 24 representative of an orientation (hereinafter and orientation signal) of at least a portion of the load handling apparatus 6, 7 with respect to the reference orientation H, G or the machine body 2. With reference to FIG. 1 the vectors depicting the path of the load at positions X, Y and Z are shown by arrows $V_x$, $V_y$, and $V_z$. The x and y components of these vectors are denoted by the dotted lines forming a right angle triangle with each arrow with the x component being parallel to horizontal ground H and the y component being parallel to gravity G. Thus it can be seen that at position X of the load handling apparatus 6, 7 the negative x component of the vector is greater for a given negative y component, than at position Y, and at position Z there is a small positive x component for a given negative y component. Therefore at position X, for a given angular velocity of the load handling apparatus, there is a greater negative linear velocity of the load L in axis x. In this embodiment in practical terms this means that the load moves forward faster when lowering the load handling apparatus from larger angles than smaller angles. In turn this means that the tipping moment relative to the axis C is increasing at a faster rate and consequently the longitudinal or forward inertia that would be generated in the load L and load handling apparatus 6, 7 if there is an abrupt cessation of movement (i.e. the operator suddenly stops lowering the load L by returning a control 13 quickly to a neutral position) is greater in position X than in positions Y and Z.

Thus, to counteract this issue, one measure is to require a greater threshold load on the second axle $A_2$ to provide a suitable safety margin in all operating conditions. However such a safety margin may be excessive in positions Y and Z, and so the machine 1 may be prevented from carrying out operations that are safe in these positions if such a threshold is present. As such the productivity of the machine for carrying out certain operations may be reduced.

Figure 3:
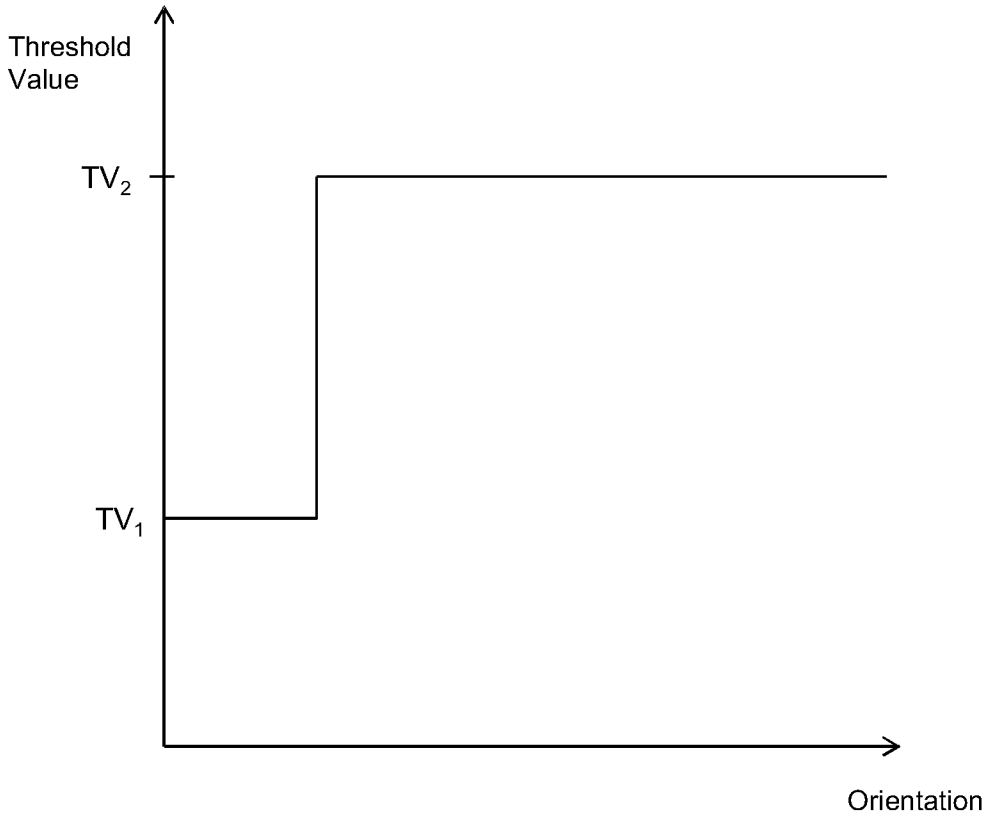
FIG. 3 is a chart illustrating a relationships between load handling apparatus orientation and a threshold value.

In an embodiment (see FIG. 3 for example), the controller 24 includes a first and a second stored threshold value $TV_1$ and $TV_2$—the first and second threshold values being different. When the signal representative of an orientation of the load handling apparatus 6, 7 indicates that the load handling apparatus 6, 7 is in a first orientation with respect to the horizontal ground H or to the machine body 2, the controller compares the signal representative of the moment of tilting with the first threshold value $TV_1$. The controller 24 may then issue a signal or command to restrict or substantially prevent a movement of the load handling apparatus 6, 7 if, for example, the signal representative of the moment of tilting is close to or is approaching the first threshold value $TV_1$.

When the signal representative of an orientation of the load handling apparatus 6, 7 indicates that the load handling apparatus 6, 7 is in a second orientation with respect to horizontal ground H or the machine body 2, the controller compares the signal representative of the moment of tilting with the second threshold value $TV_2$. The controller 24 may then issue a signal or command to restrict or substantially prevent a movement of the load handling apparatus 6, 7 if, for example, the signal representative of the moment of tilting is close to or is approaching the second threshold value $TV_2$.

In an embodiment, the first and second threshold values $TV_1$ and $TV_2$ are selected dependent on the orientation of the load handling apparatus 6, 7. A single threshold value may apply to several different orientations of the load handling apparatus 6, 7. The threshold values may be proportional to or substantially proportional to an orientation of the load handling apparatus 6, 7 with respect to the reference orientation or the machine body. The proportional or substantially proportional dependency of the threshold value on the orientation of the load handling apparatus 6, 7 may be limited to a range of orientations of the load handling apparatus 6, 7 or may be over the entire range of permitted or possible orientations of the load handling apparatus 6, 7.

In an embodiment, there is a plurality of threshold values each with a respective load handling apparatus orientation associated therewith. The threshold values and associated load handling apparatus orientations may be stored in a lookup table which can be accessed by the controller 24.

In an embodiment, the load sensor arrangement senses the weight on the second (or rear) axle $A_2$ of the machine 1. In this example embodiment, a typical load on the second axle of the machine 1 is 4000 kg to 6000 kg. A first threshold value for the controller 24 is selected to be about 1000 kg for lifting arm angles with respect to the horizontal (with the machine in an typical orientation) of less than about 30° (or less than about 20°-25° in another example), a second threshold value is selected to be about 3500 kg for lifting arm angles with respect to the horizontal of greater than about 45° (or greater than about 40° in another example). The threshold value for any angles between these angles (e.g. between 30° and 45° in one example) may be proportional or substantially proportional to the angle such that there is a substantially linear progression of the threshold value for a given angle from the first to the second threshold value between the specified angles (e.g. between 30° and 45° in one example).

A hydraulic pump 26 supplies hydraulic fluid to at least the hydraulic actuators 8, 10 which controls movement of the load handling apparatus 6, 7. The hydraulic pump 26 is driven by an electric motor 25. The electric motor 25, hydraulic pump 26 and one or more of the actuators 8, 10 can be considered to be an electrically driven actuator assembly. The electric motor 25 can be considered to be an electrical drive element of the electrically driven actuator assembly.

The controller 24 is configured to issue a control signal to control the electric motor 25 of the hydraulic pump 26 to control the supply of hydraulic fluid to the hydraulic actuators 8, 10 based on the demand of an operator based on their input from an operator control 13, as well as the tilt signal and optionally the orientation signal. For example, the control signal may cause the electric motor 25 to stop if the tilt signal indicates that a tilt threshold is exceeded, despite there being a demand from the control 13 for a particular movement of the load handling apparatus 6, 7 to occur.

Stopping the electric motor 25 driving the hydraulic pump 26 substantially prevents the supply of hydraulic fluid to the hydraulic actuators 8, 10 which prevents movement of the load handling apparatus 6, 7 which could cause the tilt threshold to be exceeded and risk tipping the working machine 1. Similarly, the control signal may restrict the electric motor 25 in some way such as causing the electric motor 25 to operate at a reduced speed (for example, slower than the desired velocity that is input by a working machine operator) when the tilt signal indicates that that the tilt threshold is approaching. This may prevent a sudden stop of the load handling apparatus 6, 7 when the tilt threshold is reached, where the inertia of such a sudden stop could lead to the working machine 1 tipping.

Therefore, the controller 24 is able to control the speed of the electric motor 25 driving the hydraulic pump 26, and stop it if necessary. This is more efficient than running the hydraulic pump constantly and restricting/diverting the flow of hydraulic fluid.

The relationship between the maximum permitted speed of operation of an actuator and an associated threshold value $TV_1$ and $TV_2$ may be controlled according to a predetermined relationship stored in the controller 24. The relationship may be a proportional relationship. The relationship may be directly proportional or proportional in accordance with a trigonometric function (such as a tangential function) or other mathematical relationship, for example. In an embodiment, the maximum permitted speed may be zero at the threshold value and may increase in direct proportion to the value of rear axle load in excess of the threshold value. For example, if the threshold value is 1000 kg, the maximum permitted lowering speed of the load handling apparatus at a rear axle load of 1200 kg is double that at 1100 kg. The maximum speed may be in terms of angular velocity or linear velocity of the load handling apparatus 6, 7 or it may be the angular velocity of the electric motor 25 or linear velocity of the actuator. The speed may be measured directly, for example, by sensing motor rotation or derived indirectly from another parameter.

In an embodiment, restricting or substantially preventing a movement of the load handling apparatus 6, 7 includes restricting or substantially preventing a movement of the load handling apparatus 6, 7 in one or more directions that present a risk of the machine tipping. However, movement of the load handing apparatus 6, 7 may be allowed or derestricted in one or more directions that reduce the risk of the machine tipping. For example, the controller 24 may be configured to issue a control signal to control the electric motor 25 of the hydraulic pump 26 to supply hydraulic fluid to the hydraulic actuator 8 and/or hydraulic actuator 10 based on an input from an operator control 13 which indicates a desire to move the hydraulic actuator 8 and/or hydraulic actuator 10 in a direction that reduces the tilt signal below the tilt threshold. The controller 24 may also lift speed restrictions as the tilt signal moves away from the tilt threshold.

In the instance that a demand is received from operator control 13 to move a first hydraulic actuator in a direction that reduces the tilt signal below the tilt threshold but to move a second hydraulic actuator in a direction that increases the tilt signal above the tilt threshold, the controller 24 may issue a control signal which permits the first hydraulic actuator to move while preventing or restricting the second hydraulic actuator from moving. This may be done in the case when each hydraulic actuator has a separate hydraulic pump 26 by controlling the hydraulic pump 26 individually, or in the case where there is only a single hydraulic pump 26 by controlling a valve to restrict or divert the supply of hydraulic fluid to the second actuator.

In an embodiment in which the load handling apparatus 6, 7 includes a lifting arm 6, 7, restricting or substantially preventing a movement of the lifting arm 6, 7 may prevent lowering of the arm 6, 7 to reduce the risk of the machine tipping but may allow movement of the lifting arm 7 in a direction that reduces the risk of the machine tipping, such as raising and/or retraction of the lifting arm 7.

Restricting or substantially preventing a movement of the load handling apparatus 6, 7 is intended to seek to reduce the risk of the machine tipping by preventing or restricting a movement which would otherwise tip—or risk tipping—the machine 1. The use of a threshold value $TV_1$ $TV_2$ which is dependent on an orientation of the load handling apparatus 6, 7 is intended to seek to avoid restricting movement of the load handling apparatus 6, 7 based on a demand from an operator via the controls 13 needlessly, when there is little or no risk of tipping the machine 1 or moving out of safety limits.

The controller 24 may operate according to an algorithm which enables the controller to ignore transient changes of loading sensed by the sensor as a result of changing machine dynamics or of reaction to initial lift arm movements.

The electric motor 25 driving the hydraulic pump is separate from an electric motor M which propels the working machine 1 and separate from any electric steering motor S. Therefore, the controller 24 is able to independently control the speed of the electric motor 25 driving the hydraulic pump 26 to prevent tipping, without adversely affecting propulsion or steering.

The tilt threshold value(s) for a particular working machine will be dependent on the working machine characteristics. For example, the tilt threshold may be dependent on the geometry of the working machine, the mass of the working machine, the geometry and mass of the load handling apparatus 6, 7. Further, for working machines in which the load handling apparatus 6, 7 is telescopically extendible, a given angular velocity will result in a differing x and y component of linear velocity dependent upon the extension of the load handling apparatus. As such an extension sensor (not shown) may also signal the controller 24 and the controller 24 may adjust the threshold value according to the extension. The threshold values are selected in an attempt to prevent tipping of the working machine during operation.

The working machine 1 may include one or more stabilizers S which may be extended (deployed) or retracted from the working machine body 2. The or each stabilizer S preferably extends from a part of the working machine body 2 which is towards the load handling implement 11 of the working machine 1. There are preferably two stabilizers S and each stabilizer is preferably located adjacent to a wheel which is coupled to the first (or front) axle.

The or each stabilizer S is configured to be extended such it makes contact with a ground surface (as depicted in broken lines in FIG. 1) and restricts movement of the working machine 1 about an axis (for example, axis C) which may be induced by the moment of tilt caused by the load L. In other words, lowering the stabilizers S into contact with the ground moves the tipping axis forwards, so the working machine 1 provides a greater counterbalancing moment and the tipping moment of the load L, load handling implement 11 and load handling apparatus 6, 7 is reduced, resulting in a greater forward stability for a given load weight and location.

For working machines 1 of the teachings it is typically not required for there to be further stabilizers adjacent to or rearward of the rear axle. This is because such stabilizers would not offer an appreciable increase in forward stability and there is typically no requirement for rearward stability since the load would not ordinarily placed in a position where it overhangs a rear of the working machine.

In other words, an optimal forward stability can be achieved by the front of the working machine being supported on the stabilizer(s) S and the rear of the working machine is supported on the wheels 5 mounted to axle $A_2$.

If the working machine 1 includes one or more stabilisers S, then the controller 24 may be further configured to receive a signal from a stabiliser sensor 28, the signal being representative of whether or not the or each stabiliser has been deployed. If the or each stabiliser S has been deployed, then the threshold values used by the controller 24 may be different from those which are used without the or each stabiliser S deployed. The controller 24 may include a first set of threshold values for when the or each stabiliser S is not deployed and a second set of threshold values for when the or each stabiliser S is deployed. The threshold values used when the or each stabiliser S is deployed may be higher than the threshold values used for corresponding orientations of the load handling apparatus 6, 7 when the or each stabilizer S is not deployed.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the teachings in diverse forms thereof. It will be appreciated that numerous changes may be made within the scope of the present teachings.

For example, although the working machine 1 has been described in terms of having an electric motor M for propulsion, the working machine could be propelled with a conventional (e.g. diesel) engine where the separate electric motor 25 driving the hydraulic pump 26 still allows for independent control of the hydraulic pump 26, which provides improved efficiency over running the hydraulic pump 26 constantly from the conventional engine. Further, other forms of electrically driven actuator assemblies may be employed. For example, linear electric motors may be employed or electric motors connected to leadscrew, ball screw, rack and pinion, cable, chain, belt or other gear arrangements.

The invention claimed is:

1. A working machine comprising:

a body and a load handling apparatus coupled to the body, wherein the load handling apparatus is moveable with respect to the body by an electrically driven actuator assembly, the electrically driven actuator assembly including a hydraulic actuator, a hydraulic pump configured to provide hydraulic fluid to the hydraulic actuator, and an electrical load handling motor operatively coupled to the hydraulic pump to drive the hydraulic pump;

a propulsion motor operatively coupled to a drive system, the propulsion motor including at least one of an electric motor or an internal combustion engine, the drive system including at least one of a set of wheels or a set of tracks and arranged for moving the working machine over a ground surface;

a control system, the control system operatively coupled to the propulsion motor and the electrical load handling motor, and wherein the control system comprises a controller configured to:

receive a tilt signal from a tilt sensor, the tilt signal representative of a moment of tilt of the working machine, and issue a control signal configured to control at least one of the hydraulic pump or the electrical load handling motor based on a value of the tilt signal relative to a tilt threshold;

wherein a speed of the electrical load handling motor is controlled by the controller and wherein the propulsion motor is operable independently of the electrical load handling motor; and wherein, during operation of the propulsion motor, the speed of the electrical load handling motor is configured to be reduced or stopped, thereby reducing or eliminating driving of the hydraulic pump.

2. The working machine according to claim 1, wherein the control signal is configured to: reduce a speed of the at least one of the hydraulic pump or the electrical load handling motor as the value of the tilt signal approaches the tilt threshold, and/or prevent movement of the electrically driven actuator assembly which would cause the value of the tilt signal to exceed the tilt threshold.

3. The working machine according to claim 1, wherein when the value of the tilt signal reaches or exceeds the tilt threshold, the control signal is configured to only allow movement of the electrically driven actuator assembly in a direction which would cause the value of the tilt signal to reduce below the tilt threshold.

4. The working machine according to claim 1, wherein the controller is further configured to receive a load orientation signal representative of an orientation of the load handling apparatus with respect to a reference orientation, the tilt threshold being dependent on the load orientation signal.

5. The working machine according to claim 1, wherein the control signal is configured to control the electrical load handling motor driving the hydraulic pump to control a supply of hydraulic fluid to the hydraulic actuator based on the value of the tilt signal relative to the tilt threshold.

6. The working machine according to claim 5, wherein the control signal is configured to control the electrical load handling motor driving the hydraulic pump to restrict the supply of hydraulic fluid to the hydraulic actuator in order to restrict movement of the load handling apparatus based on the value of the tilt signal relative to the tilt threshold.

7. The working machine according to claim 6, wherein the control signal is configured to stop the electrical load handling motor driving the hydraulic pump based on the value of the tilt signal reaching or exceeding the tilt threshold to substantially prevent the supply of hydraulic fluid to the hydraulic actuator in order to prevent a movement of the load handling apparatus which would cause the value of the tilt signal to exceed the tilt threshold.

8. The working machine according to claim 6, wherein when the value of the tilt signal reaches or exceeds the tilt threshold, the control signal is configured to operate the electrical load handling motor driving the hydraulic pump to supply hydraulic fluid to the hydraulic actuator only so that the hydraulic actuator can be moved in a direction which reduces the value of the tilt signal below the tilt threshold.

9. The working machine according to claim 1, wherein the controller is further configured to receive a stabilizer signal representative of whether one or more stabilizers of the working machine are deployed, and the tilt threshold is further dependent on the stabilizer signal.

10. The working machine according to claim 1, wherein the tilt signal represents the load on an axle of the working machine.

11. The working machine of claim 1, wherein the tilt sensor includes at least one of a strain gauge on an axle or a load cell disposed between the body and the axle.

12. The working machine according to claim 1, wherein the load handling apparatus comprises a lifting arm, the lifting arm being pivotable with respect to the working machine body.

13. The working machine according to claim 12, wherein the lifting arm is pivotable about a location between a longitudinal mid-point of the body and a rear of the body.

14. The working machine according to claim 12, wherein the lifting arm is telescopic.

15. The working machine according to claim 12, wherein the lifting arm has a fixed orientation in a vertical plane with respect to the body.

16. The working machine according to claim 12, wherein the working machine further comprises a ground engaging propulsion structure to permit movement thereof over the ground.

17. The working machine according to claim 12, further comprising an electrical energy store configured to provide electrical energy to the actuator assembly.

18. The working machine according to claim 12, wherein the hydraulic pump comprises the electrical load handling motor and the working machine comprises at least one of an independent electric steering motor or an independent electric traction motor.

19. The working machine according to claim 12, wherein the electrically driven actuator assembly uses an electrical source of power to drive movement of the load handling apparatus.

* * * * *